United States Patent [19]

Wurster

[11] Patent Number: 4,833,053

[45] Date of Patent: May 23, 1989

[54] PHOTOCONDUCTIVE DEVICES CONTAINING SQUARILIUM DYE COMPOSITIONS

[75] Inventor: Herbert K. Wurster, Los Gatos, Calif.

[73] Assignee: Ricoh Corporation, San Jose, Calif.

[21] Appl. No.: 244,572

[22] Filed: Sep. 12, 1988

Related U.S. Application Data

[63] Continuation of Ser. No. 915,135, Oct. 3, 1986, abandoned.

[51] Int. Cl.[4] ..... G03G 5/06; G03G 5/14

[52] U.S. Cl. ..... 430/58; 430/59; 430/74; 564/307

[58] Field of Search ..... 430/58, 59, 74; 564/307

[56] References Cited

U.S. PATENT DOCUMENTS

| | | | |
|---|---|---|---|
| 4,524,219 | 6/1985 | Law | 564/307 |
| 4,525,592 | 6/1985 | Law | 564/307 |
| 4,585,895 | 4/1986 | Law | 564/307 |

*Primary Examiner*—Roland E. Martin

*Attorney, Agent, or Firm*—Flehr, Hohbach, Test, Albritton & Herbert

[57] ABSTRACT

Novel squaric acid methine dyes are provided. These dyes are useful in forming photoconductive layers for components utilized in electrographic imaging processes.

8 Claims, 6 Drawing Sheets

PHOTOCONDUCTIVE DEVICES CONTAINING SQUARILIUM DYE COMPOSITIONS

This is a continuation of application Ser. No. 915,135 filed Oct. 3, 1986, now abandoned.

The present invention is directed to novel squarilium dyes (squaric acid methine dyes) and photoconductive devices containing such dyes.

BACKGROUND OF THE INVENTION

U.S. Pat. No. 3,617,270 discloses the use of squaric acid methine dyes for the optical sensitization of zinc oxide. U.S. Pat. Nos. 3,824,900, 3,837,851, 4,123,270 and 4,150,987 disclose the use of squaric acid methine dyes for a charge generation layer with a p-type charge transport layer in a multilayered electrophotographic plate.

U.S. Pat. No. 4,500,621 discloses electrophotographic plates containing squaric acid methine dyes in a binder, characterized by photoreceptive sensitivity in the infrared region.

It is an object of the present invention to provide novel squaric acid methine dyes which are useful as photoreceptors in single or multilayer electrophotographic plates.

SUMMARY OF THE INVENTION

Figure 1:
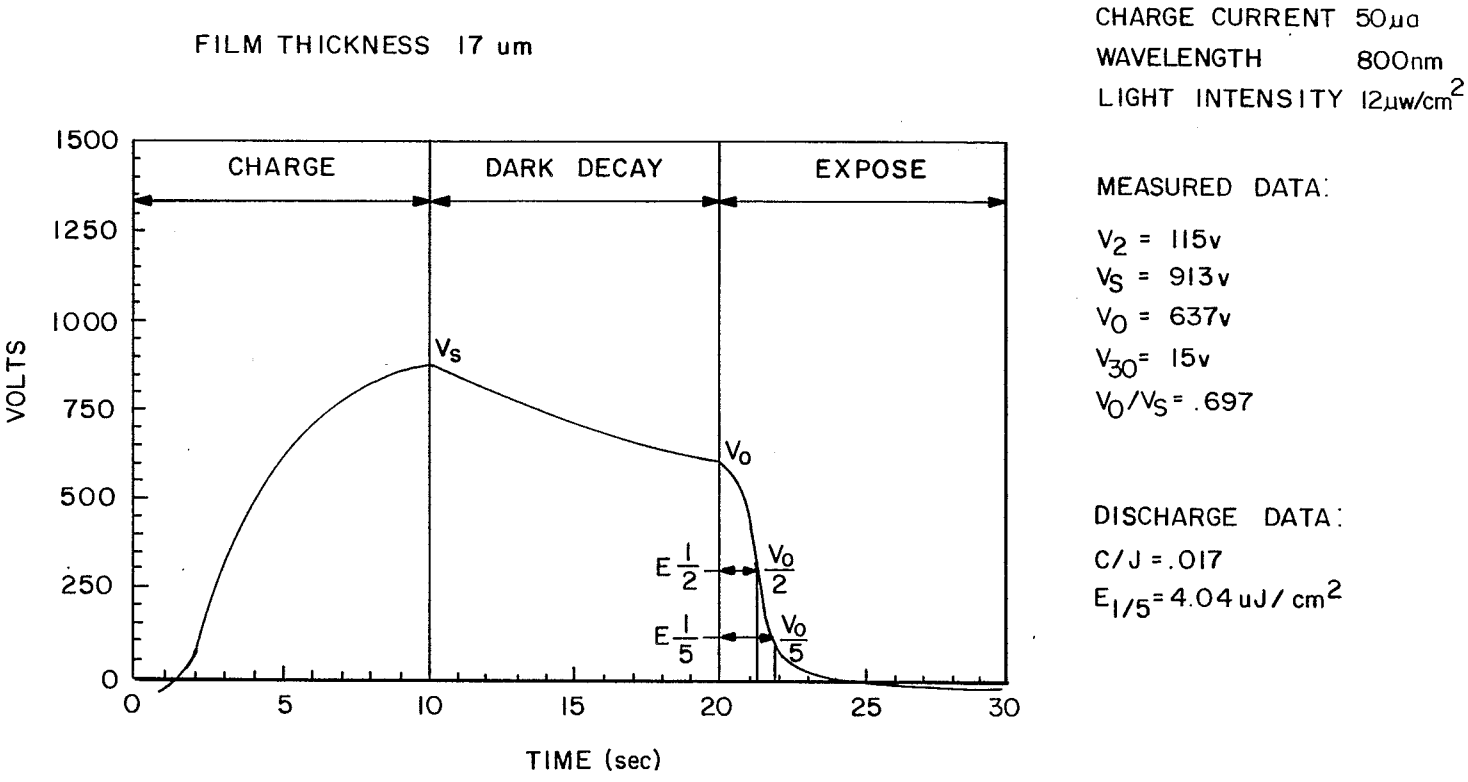
FIG. 1 is a time-voltage plot of tests conducted on a single-layer electrophotographic plate according to the present invention utilizing a conventional static charge analyzer under exposure at the wave length of 800 nm.

The present invention is directed to novel squaric acid methine dyes of the following formula:

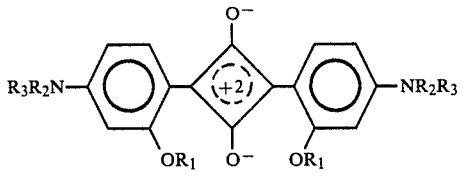

I wherein $R_1$, $R_2$ and $R_3$ are independently alkyl groups of from 1 to 10 carbon atoms. The term alkyl groups includes linear and branched groups. Groups containing from 1 to 6 carbon atoms are preferred. Exemplary alkyl groups include methyl, ethyl, isopropyl, n-propyl, n-butyl, isobutyl, and the like.

A particularly preferred squaric acid methine dye is that dye in Formula I wherein $R_1$, $R_2$ and $R_3$ are all methyl.

The dyes according to the present invention may be prepared from an appropriate N,N-dialkyl m-alkoxyaniline by refluxing in an appropriate solvent with a squaric acid. Preparation of the starting material anilines may be prepared by known methods as, for example, described by Kenichi Fukui, et al. *Kogyo Kagaku Zasshi* 62: 531–534 (1959). Appropriate solvents include alcohols, preferably n-butanol.

Other general methods for preparing squaric acid methine dyes are disclosed in Treibes, et al., *Angew. Chem. Internat. Ed.* 4, 695 (1965); Sprenger, et al., *Angew. Chem. Internat. Ed.* 5, 894 (1966); and Treibes, et al. *Leibig's Ann. Chem.*, 712, 123 (1968), disclosures of which are incorporated herein by reference. Generally, squaric acid is reacted with the desired substituted aniline in a suitable solvent with heating. The product is isolated by cooling the reaction mixture to obtain crystals or by adding thereto a non-solvent for the dye. Squaric acid methine dyes are also disclosed in U.S. Pat. No. 4,175,956 as being useful the electrophoretic migration imaging processes.

The dyes according to the present invention may be utilized in preparing electrophotographic plates either in single or multilayered configuration. Generally, the dyes, after being dried, are milled to particle sizes in the range of about 2 to 30 millimicrons in diameter. The particular particle size distribution may depend on the reprecipitation process used to isolate the dyes, the milling time and solvents used to prepare the dye preparation. Generally, with decrease of particle size the charge acceptance and sensitivity of the photoreceptor increases while the residual and dark decay is decreased. Generally, a binder is used with the dye particles to form a layer on the electrophotographic plate. The solvent used to prepare the dye-binder preparation is selected on the basis of polymer-binder solubility and volatility. Solvents which may be utilized to prepare dye-binder slurries include ethers, cyclic ethers, halogenated hydrocarbons, ketones, aliphatic solvents and aromatic solvents. A preferred class of solvents comprises tetrahydrofuran, chloroform, methylene chloride, carbon tetrachloride, acetone, benzene and toluene. Tetrahydrofuran and methylene chloride are particularly preferred solvents because of excellent dispersant characteristics and high volatility. Variations of solvent or solvent mixtures may be used to alter the electrical properties due to variations in polarity and drying times. Concentration of the dye-binder suspension may be adjusted to viscosities which insure suitable coating characteristics. For example, generally in dye-binder ratios varying from 1:2 to 1:10, the solvent concentrations used to prepare the slurries vary from approximately 90% to 78%, respectively.

The binders may be selected from a variety of polymers, for example, Epoxy-Epon 1007F (a 4,4'-isopropylidene diphenolepichlorohydrin resin manufactured by Shell Chemical Company), Acryloid-B 66 (a methyl butyl methacrylate copolymer manufactured by Rohm and Haas), Vylon-200 (a polyester resin manufactured by Toyob Company, Japan), Panlite L-1250 and K-1300 (a polycarbonate resin manufactured by Teijin Company, Japan), polyurethane, polystyrene and Luvicin (a polyvinylcarbazole manufactured by BASF). The dye to binder ratio in the photoconductor may be in the range from about 1:1 to about 1:40. Preferably, the dye-to-binder ratio should be in the range of 1:2 to 1:10.

The thickness of the photoconductor layer containing the squaric acid methine dyes according to the present invention is preferably about 1 to 60 microns, but thicknesses outside of this range may be also useful. Generally, as thickness of the photoconductor layer is increased, the induction period, charge acceptance and residual potential increase, while dark decay decreases. In general, these characteristics are determined by conventional tests using a static charge analyzer. The photoconductor is charged by the charge corona at a preselected current. Then the potential on the photoconductor surface is recorded and plotted on the graph as exemplified by any one of the accompanying figures. The potential at the end of the charging period is recorded as $V_s$. The photoconductor is then allowed to dark decay for a predetermined period of time (ten seconds). The potential at the end of dark decay is recorded as $D_0$. The photoconductor sample is then illuminated with incandescent light at a color temperature of 2810° K. and a surface luminance of 0.35 or 7.5 lux. The exposure in lux/seconds for discharge to $V_0/2$, $V_0/5$ and $V_0/10$ may be determined and recorded as $E_{\frac{1}{2}}$, $E_1/5$ and $E_1/10$, respectively. The potential at the end of discharge (usually about 10 seconds) is recorded as $V_{30}$. The dark decay is measured as the ratio $V_0/V_s$.

The single-layer squaric acid methine dye/binders photoreceptors according to the present invention demonstrate a charge acceptance value greater than 800 volts, residual potential of less than 100 volts, dark decay of less than 20 volts per second, with stable sensitivity under cycling conditions. The spectral response of the photoreceptor is an arrangement of about 400–900 nm. These and other characteristics of organic photoreceptors render them useful photographic processes, including use as photoreceptors and in laser diode printing processes.

The multiple-layer squaric acid methine dye/binder organic photoreceptors according to the present invention demonstrate similar characteristics, however with more attenuated results.

When used as a single layer in an electrophotographic plate, it may be advantageous to include a charge transport material in the mixture. The charge transport material may be admixed with the binder wherein about 2–50% charge transport material is used based upon weight of binder. For example, a binder mixture of 2:1 binder/charge transport material utilized in a photoconductor having a dye/binder ratio of 1:7, the sensitivity of the photoconductor is more stable than the sensitivity of a photoconductor having a 1:6 dye/binder ratio with no transport material. Exemplary charge transport materials may be triphenylamine (TPA), isopropylcarbazole, methylphenylhydrazono-3-methylidene-9-ethyl carbazole, 1-phenyl-3-(4-diethylaminostyryl)-5-(4-diethylaminophenyl)-2-pyrazoline, triphenylmethane, triphenylene, pyrene and perylene. The squaric acid methine dye may also be included in a single-layer admixed with other known metallic charge transport materials such as selenium or selenium alloys, with or without a binder.

Exemplary squaric acid methine dyes useful according to the present invention include, but are not limited to, the following:

(1)

2,4-bis-(2-ethoxy-dimethylaminophenyl)-1,3-cyclobutadienediylium-1,3-diolate;

(2)

2,4-bis-(2-methoxy-diethylaminophenyl)-1,3-cyclobutadienediylium-1,3-diolate;

(3)

2,4-bis-(2-n-propoxy-dimethylaminophenyl)-1,3-cyclobutadienediylium-1,3-diolate;

(4)

(4)2,4-bis-(2-ethoxy-4-dibutoxyaminophenyl)-1,3-cyclobutadienediylium-1,3-diolate.

The following examples are presented by way of illustration and are not intended to limit the scope of the present invention.

EXAMPLE 1

Preparation of 2,4-bis-(2-methoxy-4-dimethylaminophenyl)1,3-cyclobutadienediylium-1,3-diolate The starting material N,N-dimethyl-m-anisidine, 1.6 grams (0.01 mole), prepared according to Kenichi Fukui, et al. in *Kogyu Kagaku Zasshi* 62, 531–534 (1959) was refluxed with 0.57 grams (0.005 mmole) squaric acid in 50 ml 1-butanol for one hour. After cooling, the dye was filtered off, washed with 1-butanol, methanol, then THF and air dried. Yield approximately 0.2 grams. TLC showed the dye to be pure and the infrared spectrum agrees with the structure.

EXAMPLE 2

Preparation of a Two-layer Photoconductor Plate

A sample of 0.1 grams of the dye made in accordance with Example 1 was dry milled using 275 grams of $\frac{1}{8}$ inch stainless steel balls in a 200 ml glass jar for one hour. After addition of 3.9 grams of THF, the dye was then wet milled for one hour. This slurry was coated on aluminized Mylar at a wetgap of 0.00035 inch and allowed to air dry. This charge-generating layer was overcoated with a solution of 0.3 grams of 4-ethylcarbazole-3-carbaldehyde-1-methyl-1-phenylhydrazone in 3 grams of 10% K1300 (polycarbonate binder made by Teijin Company, Tokyo) in THF at a wetgap of 0.008 inch and then cured at 80% for 2 minutes and at 100%C for 10 minutes. The CGL layer had a film thickness of about 20–22 micrometers.

EXAMPLE 3

Preparation of a Single-layer Photoconductor

A sample of 1 gram of the THF/dye slurry as prepared in Example 2 and 0.5 grams of 40% epoxy resin 1007F (a binder made by Shell Company) plus 1 drop of FC-430-10% (a surfactant made by 3M) and THF were mixed and coated onto aluminum foil. The dye/binder ratio was 1:8. The wetgap was 0.006 inches. The photoconductor was cured at 80%C for 2 minutes and at 100° C. for 10 minutes. The film thickness was about 17–20 micrometers.

EXAMPLE 4

The photoconductor plates made as described in Examples 2 and 3 above were tested utilizing a Princeton static charge analyzer (Model 276). Referring to FIG. 1, the photoconductor of Example 3 (single-layer) was exposed at 800 NM at 12 $\mu w/cm^2$. Charge acceptance was over 800 volts.

Figure 2:
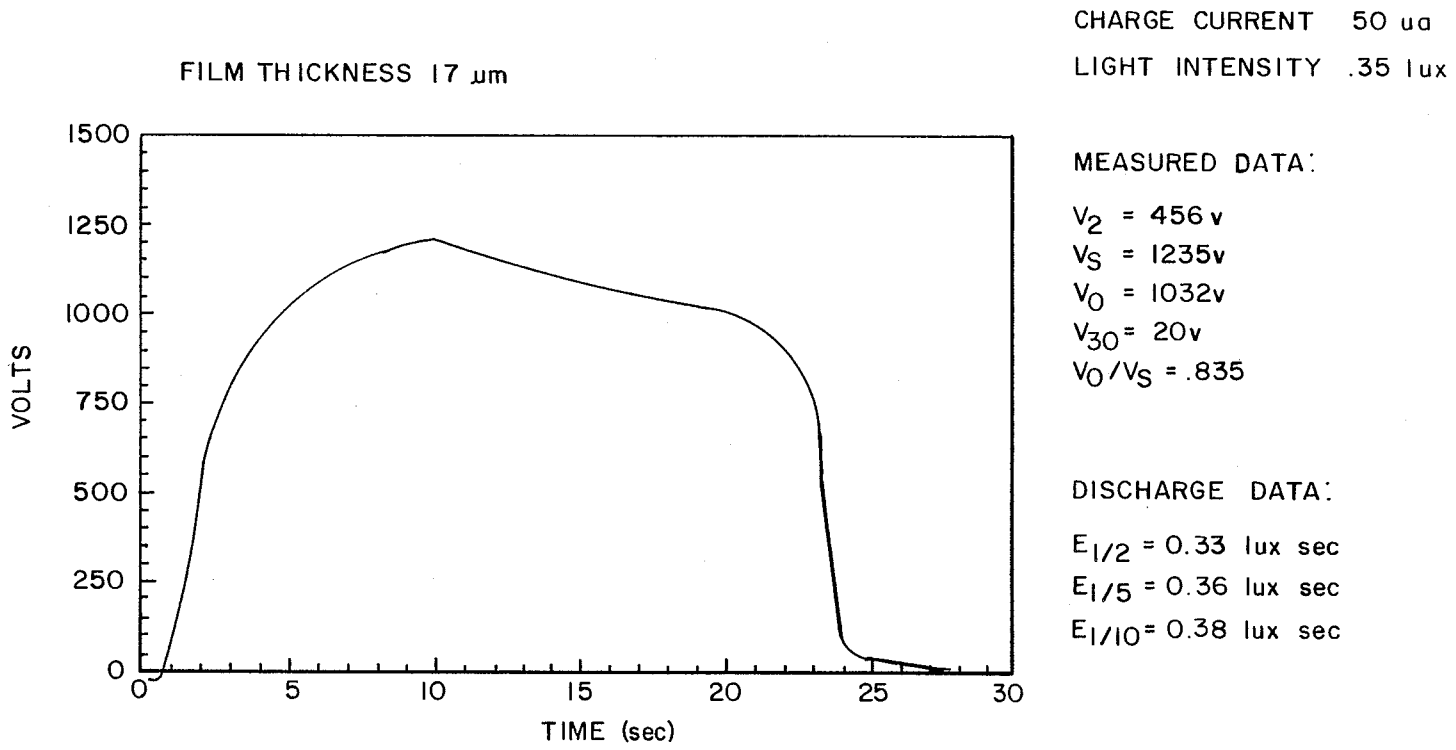
FIG. 2 is a time-voltage plot of the same plate as tested in FIG. 1 under exposure of white light at 0.35 lux.
Figure 3:
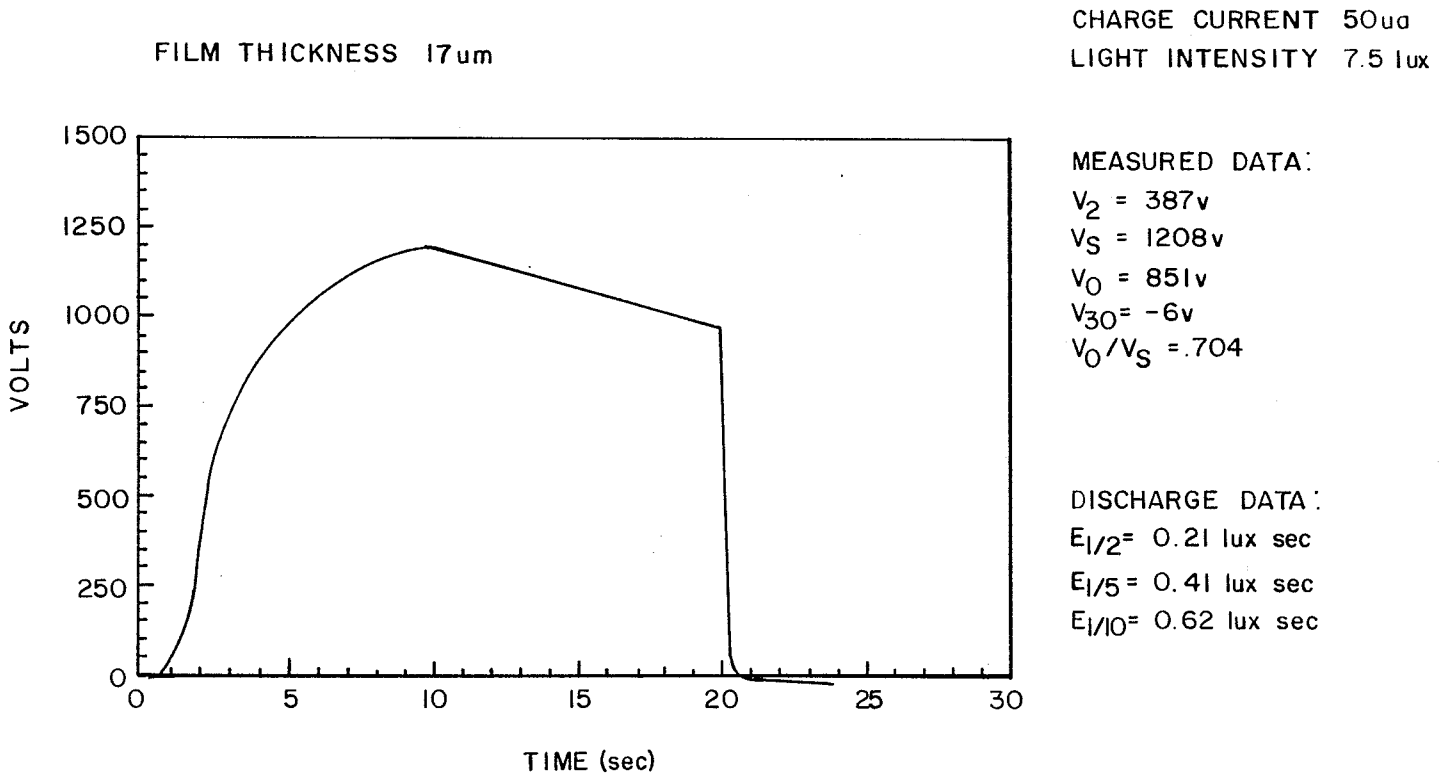
FIG. 3 is a graph of a time-voltage plot of the same plate as described in FIG. 1 under exposure of white light at 7.5 lux.

Referring to FIG. 2, the same photoconductor was subjected to exposure under white light at 0.35 lux. The charge acceptance was over 1200 volts. The same photoconductor was exposed to white light at 7.5 lux. The charge acceptance was over 1200 volts.

Figure 4:
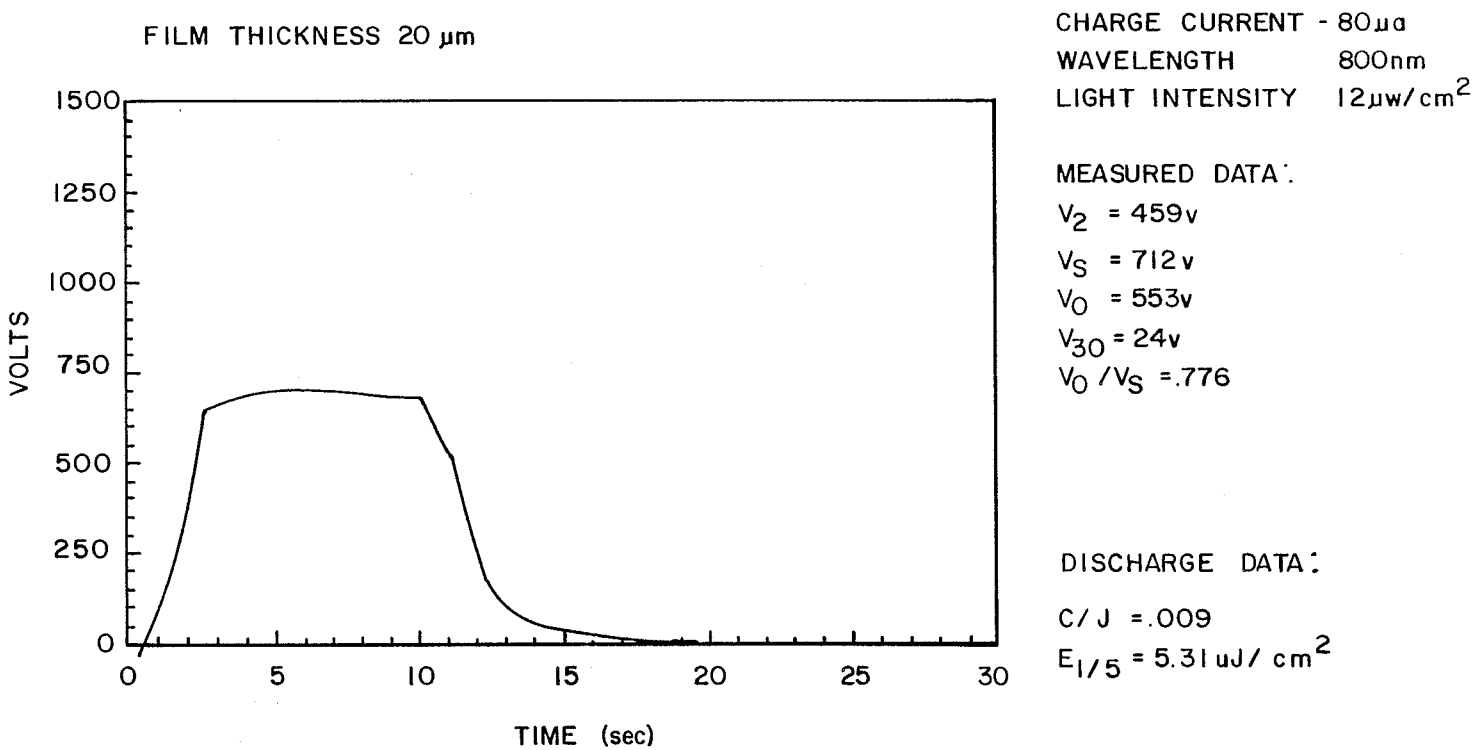
FIG. 4 is a graph of a time-voltage plot of a two-layer electrophotographic plate according to the present invention under exposure at 800 nm in a conventional static charge analyzer.
Figure 5:
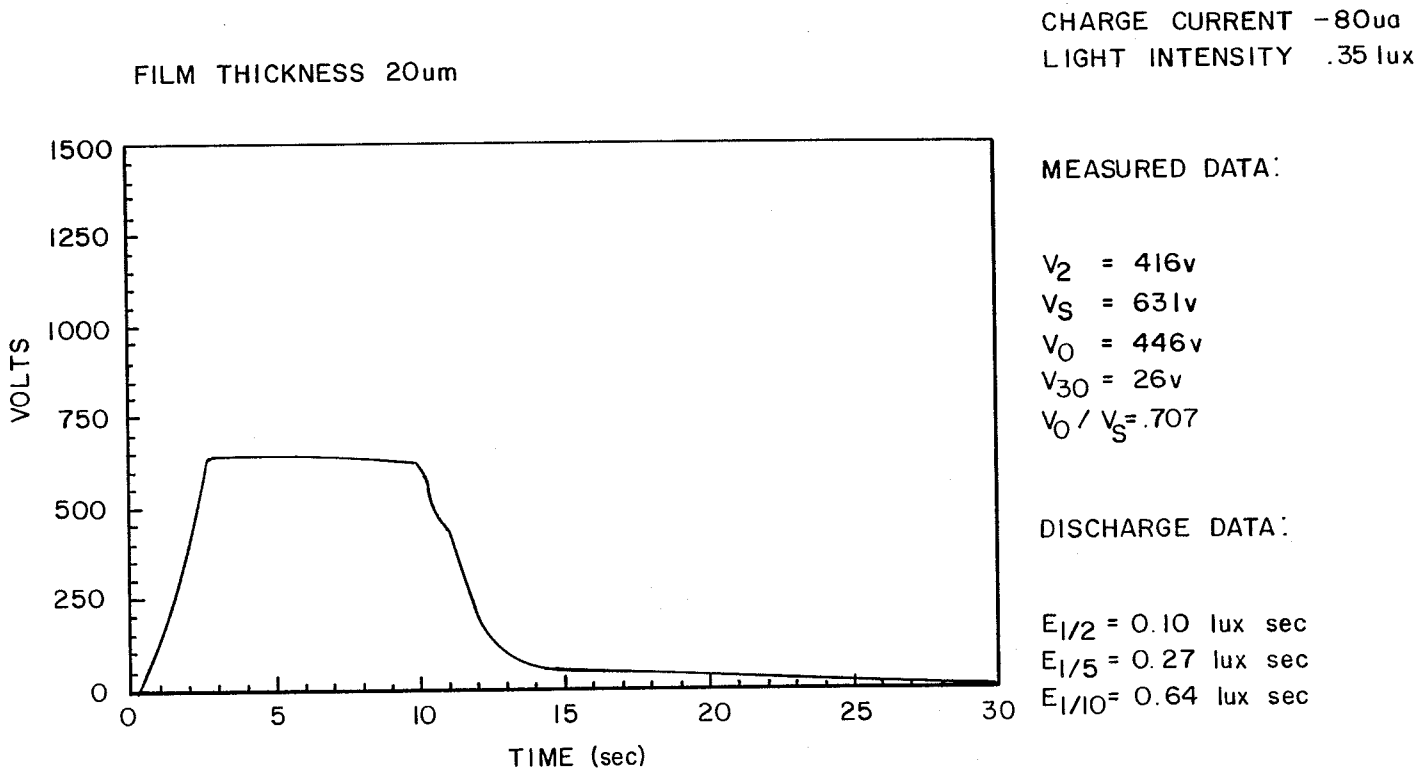
FIG. 5 is a time-voltage plot of the same plate described in FIG. 4 under exposure of white light at 0.35 lux.
Figure 6:
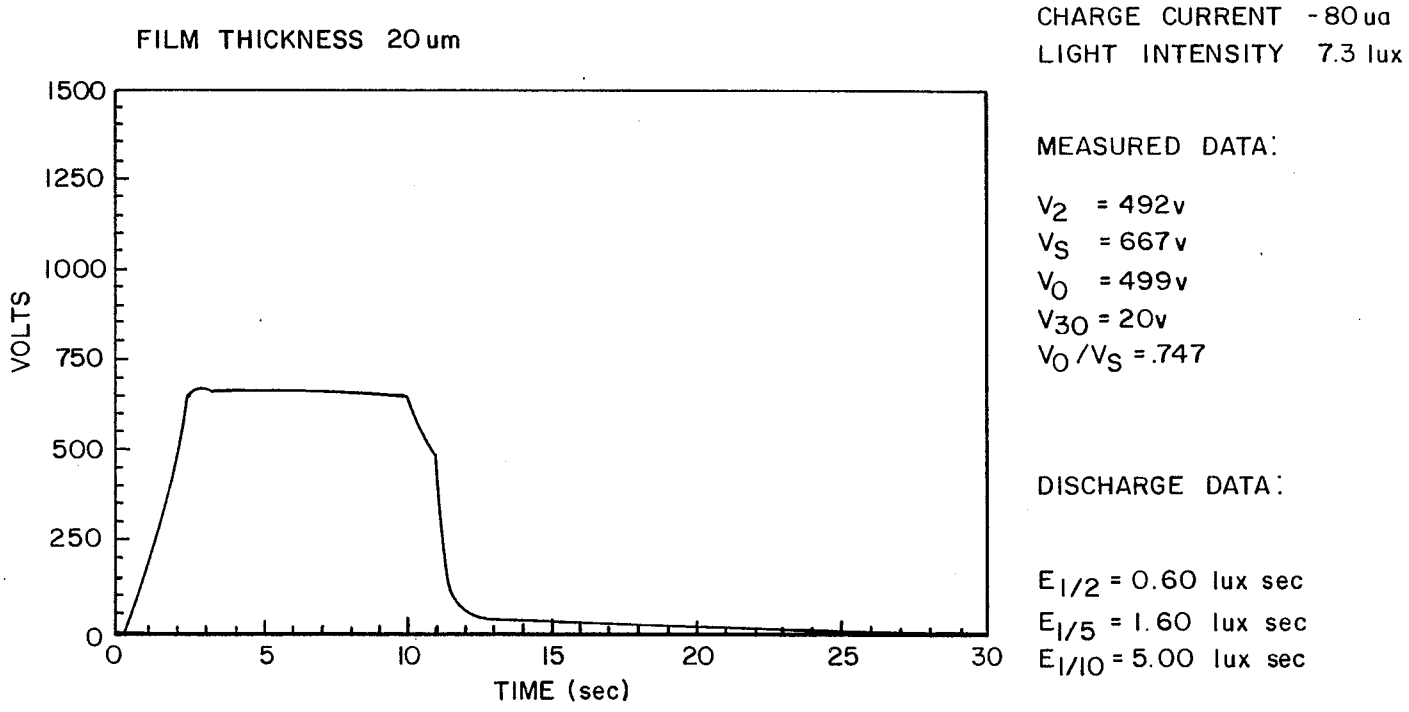
FIG. 6 is a time-voltage plot of the same plate as described in FIG. 4 under exposure of white light at 7.5 lux.

Referring to FIG. 4, the photoconductor made in accordance with Example 1 (dual-layer) was subjected to exposure at 800 NM at 12 $\mu w/cm^2$. The charge acceptance was less than 750 volts. The same photoconductor was exposed in FIGS. 5 and 6 to white light at 0.35 and 7.5 lux, respectively. Charge acceptance in both cases was less than 750 volts.

I claim:

1. A photoreceptor plate comprising a solid continuous photoconductor layer of uniform thickness, wherein the photosensitive material said layer consists essentially of a squaric acid methine dye according to Formula I:

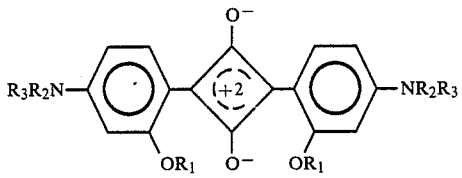

I wherein $R_1$, $R_2$ and $R_3$ are independently selected from the group consisting of alkyl groups of 1 to 10 carbon atoms.

2. A photoreceptor plate according to claim 1 wherein said alkyl groups contain from 1 to 6 carbon atoms.

3. A photoreceptor plate according to claim 2 wherein $R_1$, $R_2$ and $R_3$ are all methyl groups.

4. A photoreceptor plate according to claim 1 comprising a single photoconductor layer.

5. A photoreceptor plate according to claim 1 comprising a charge generating layer containing said dye and a charge transporting layer.

6. A process for forming a latent electrostatic image upon a layered photoresponsive device comprising a solid continuous photoconductor layer of uniform thickness comprising the steps of uniformly charging said photoconductor layer and imagewise exposure to a light source wherein said photoconductor layer consists essentially of a binder and a squaric acid methine dye of the formula I:

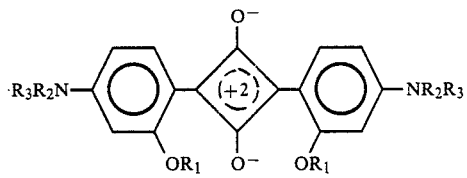

I wherein said $R_1$, $R_2$ and $R_3$ are selected from the group consisting of alkyl groups of 1 to 10 carbon atoms; then exposing said photoconductor layer to an image pattern of radiation to which said layer is photosensitive.

7. A process according to claim 6 wherein said alkyl groups contain from 1 to 6 carbon atoms.

8. A process according to claim 7 wherein $R_1$, $R_2$ and $R_3$ are all methyl groups.

* * * * *

UNITED STATES PATENT AND TRADEMARK OFFICE

CERTIFICATE OF CORRECTION

PATENT NO. : 4,833,053

DATED : May 23, 1989

INVENTOR(S) : Herbert K. Wurster

It is certified that error appears in the above—identified patent and that said Letters Patent is hereby corrected as shown below:

On the first page, at [73] Assignee, add the following:

--Ricoh Co., Ltd., Tokyo, Japan--

Signed and Sealed this

Thirteenth Day of March, 1990

*Attest:*

JEFFREY M. SAMUELS

*Attesting Officer*

*Acting Commissioner of Patents and Trademarks*